US008748787B2

(12) United States Patent
Weiss et al.

(10) Patent No.: US 8,748,787 B2
(45) Date of Patent: Jun. 10, 2014

(54) METHOD OF GUIDING A SALVO OF GUIDED PROJECTILES TO A TARGET, A SYSTEM AND A COMPUTER PROGRAM PRODUCT

(75) Inventors: Martin Weiss, The Hague (NL); Marcel Gregorius Anthonius Ruizenaar, Zoetermeer (NL)

(73) Assignee: Nederlandse Organisatie voor toegepast-natuurwetenschappelijk onderzoek TNO (NL)

( * ) Notice: Subject to any disclaimer, the term of this patent is extended or adjusted under 35 U.S.C. 154(b) by 0 days.

(21) Appl. No.: 13/698,295

(22) PCT Filed: May 27, 2011

(86) PCT No.: PCT/NL2011/050371

§ 371 (c)(1),
(2), (4) Date: Jan. 25, 2013

(87) PCT Pub. No.: WO2011/149350

PCT Pub. Date: Dec. 1, 2011

(65) Prior Publication Data

US 2013/0126667 A1 May 23, 2013

(30) Foreign Application Priority Data

May 27, 2010 (EP) ..... 10164125

(51) Int. Cl.

| | |
|---|---|
| ***F41G 7/24*** | (2006.01) |
| ***F41G 3/04*** | (2006.01) |
| *F41G 7/00* | (2006.01) |
| *F41G 3/00* | (2006.01) |

(52) U.S. Cl.

USPC ..... 244/3.13; 244/3.1; 244/3.11; 89/1.11

(58) Field of Classification Search

USPC ..... 244/3.1–3.19; 89/1.11; 342/61, 62, 175, 342/195; 701/1

See application file for complete search history.

(56) References Cited

U.S. PATENT DOCUMENTS 3,741,501 A * 6/1973 Salkeld ..... 244/3.14
3,974,740 A 8/1976 Billottet et al.

(Continued)

FOREIGN PATENT DOCUMENTS

EP 0313536 A1 4/1989
EP 0329523 A1 8/1989
FR 2569832 A1 3/1986

OTHER PUBLICATIONS

International Search Report—PCT/NL2011/050371—Mailing date: Aug. 18, 2011.

(Continued)

*Primary Examiner* — Bernarr Gregory
(74) *Attorney, Agent, or Firm* — Banner & Witcoff, Ltd.

(57) ABSTRACT

The invention relates to a method of guiding a salvo of guided projectiles to a target. The method comprises the steps of generating a beam defining a common reference coordinate system, determining the position of each projectile relative to the beam, and providing to each projectile: position information of other projectiles. Further, the method includes the step of associating dispersion parameters to the salvo of guided projectiles. In addition, the method comprises the step of determining numerical values of the dispersion parameters based on accuracy uncertainty. Also, the method includes the step of controlling the projectiles to an optimal dispersion by using a swarming technique based on the position information of the projectiles and on the numerical values of the dispersion parameters.

13 Claims, 4 Drawing Sheets

(56) References Cited

U.S. PATENT DOCUMENTS

| | | | | |
|---|---|---|---|---|
| 4,274,609 | A * | 6/1981 | Ferrier et al. | 244/3.14 |
| 4,709,875 | A | 12/1987 | Cremosnik et al. | |
| 4,712,181 | A | 12/1987 | Dahlberg | |
| 4,901,946 | A | 2/1990 | Arnaud et al. | |
| 5,601,255 | A * | 2/1997 | Romer et al. | 244/3.13 |
| 5,788,178 | A | 8/1998 | Barrett, Jr. | |
| 6,474,593 | B1 | 11/2002 | Lipeles et al. | |
| 6,630,902 | B1 | 10/2003 | Fenton et al. | |
| 7,047,861 | B2 * | 5/2006 | Solomon | 89/1.11 |
| 7,121,502 | B2 | 10/2006 | Krikorian et al. | |
| 7,338,009 | B1 * | 3/2008 | Bobinchak et al. | 244/3.15 |
| 7,422,175 | B1 * | 9/2008 | Bobinchak et al. | 244/3.15 |
| 7,631,833 | B1 * | 12/2009 | Ghaleb et al. | 244/3.15 |
| 7,675,012 | B1 * | 3/2010 | Bobinchak et al. | 244/3.15 |
| 7,947,936 | B1 * | 5/2011 | Bobinchak et al. | 244/3.15 |
| 2004/0068415 | A1 * | 4/2004 | Solomon | 701/1 |
| 2004/0134336 | A1 * | 7/2004 | Solomon | 89/1.11 |
| 2004/0134337 | A1 * | 7/2004 | Solomon | 89/1.11 |
| 2008/0001022 | A1 | 1/2008 | Sa et al. | |

OTHER PUBLICATIONS

Yanfei Liu and Kevin M. Passino, "Stable Social Foraging Swarms in a Noisy Environment", IEEE Transactions on Automatic Control, vol. 49, No. 1, Jan. 2004.

Veysel Gazi and Kevin M. Passino, "A class of attractions/repulsion functions for stable swarm aggregations", Int. J. Control, 2004, vol. 77, No. 18, 1567-1579.

Veysel Gazi and Kevin M. Passino, "Stability Analysis of Swarms", IEEE Transactions on Automatic Control, vol. 48, No. 4, Apr. 2003.

Zhao Shiyu and Zhou Rui, "Cooperative Guidance for Multimissile Salvo Attack", Chinese Journal of Aeronautics 21(2008) 533-539.

* cited by examiner

METHOD OF GUIDING A SALVO OF GUIDED PROJECTILES TO A TARGET, A SYSTEM AND A COMPUTER PROGRAM PRODUCT

CROSS-REFERENCE TO RELATED APPLICATIONS

This application is a U.S. National Stage application under 35 U.S.C. §371 of International Application PCT/NL2011/050371 (published as WO 2011/149350 A1), filed May 27, 2011, which claims priority to Application EP 10164125.6, filed May 27, 2010. Benefit of the filing date of each of these prior applications is hereby claimed. Each of these prior applications is hereby incorporated by reference in its entirety.

FIELD OF THE INVENTION

The present invention relates to a method of guiding a salvo of guided projectiles to a target.

BACKGROUND OF THE INVENTION

The effectiveness of a weapon system is a combination of lethality and precision. The tendency of modern systems to reduce lethality and trade it for precision has gone a long way in providing sophisticated weapons of high precision, able to achieve in one round the same effect that was previously achieved with tens of rounds. There are, however, limits of what can be achieved in each situation in terms of precision of delivery. Even if technological progress is pushing the technical limits further and further, achieving higher precision of delivery comes at a cost that may become prohibitive. Flight steering mechanisms, inertial sensors and target sensors are necessary ingredients for improving the precision of delivery, but they also add to the price of guided rounds. A great deal of work is devoted to find the right combination of these elements in order to satisfy the operational requirements for a minimum cost per round. In particular, different guidance principles have been devised to address the need of higher precision, while keeping the costs limited. Inertial guidance systems (with their modern GPS-aided variants), beam rider systems, command guidance, active, semi-active and passive homing guidance systems are examples of such guidance principles that are currently used for various purposes. Each of them has its own advantages and limitations. Each of them comes with a different distribution of resources between the round and the launching weapon system, and each of them has different requirements in terms of weapon system support, communications, etc. Typical for all these guidance principles is that they aim at improving the precision of each projectile separately.

SUMMARY OF THE INVENTION

It is an object of the invention to obtain a method according to the preamble wherein at least one of the disadvantages is reduced. In particular, the invention aims at obtaining a method according to the preamble wherein the effectiveness of guided projectiles is improved. Thereto, the method according to the invention comprises the steps of generating a beam defining a common reference coordinate system, determining the position of each projectile relative to the beam, providing to each projectile: position information of other projectiles, associating dispersion parameters to the salvo of guided projectiles, determining numerical values of the dispersion parameters based on accuracy uncertainty, and controlling the projectiles to an optimal dispersion by using a swarming technique based on the position information of the projectiles and on the numerical values of the dispersion parameters.

By determining numerical values of dispersion parameters associated to the salvo of guided projectiles, based on accuracy uncertainty, the distribution of the individual projectiles in a salvo can be controlled, depending on accuracy uncertainty, to maximize the chance that at least one projectile of the salvo, or as many projectiles as deemed necessary for an effective engagement, will hit a target. As a result, the effect of the salvo of the ensemble of a salvo of guided projectiles is improved.

The invention is at least partially based on the observation that if the dispersion of the projectiles in a salvo is very small, but the projectiles are not correctly aimed at the target, all the projectiles will miss. In order to benefit from this observation, according to an aspect of the invention, the dispersion of the projectiles in a salvo should be correlated with accuracy uncertainty, including e.g. a target prediction position error, an aiming error and/or flight disturbance. This is particularly important in the case of fast moving targets where the error in predicting the target position can be quite significant.

By controlling the flight paths of the individual guided projectiles in accordance with the determined corresponding dispersion parameter values, relatively cheap steering techniques can be used in order to control the desired dispersion of the projectiles in a salvo.

Advantageously, a swarming guidance technique is used, so that ideas and techniques from the area of swarm formation and stability can advantageously be used to enable individual projectiles in a salvo to arrange themselves in a desired dispersion. The dispersion parameters can be used to implement a swarming technique that prescribes the desired dispersion of the individual projectiles.

In an advantageous manner, the effectiveness of projectiles can improve significantly at a reduced increase of costs, thereby providing an alternative to high value weapons such as homing missiles.

Preferably, the step of determining numerical values of the dispersion parameters is performed based on available information on the target (predicted) position error and the target size in such a way so as to maximize the chance of hitting the target.

The invention also relates to a system for guiding a salvo of guided projectiles to a target.

Further, the invention relates to a computer program product. A computer program product may comprise a set of computer executable instructions stored on a data carrier, such as a flash memory, a CD or a DVD. The set of computer executable instructions, which allow a programmable computer to carry out the method as defined above, may also be available for downloading from a remote server, for example via the Internet.

Other advantageous embodiments according to the invention are described in the following claims.

BRIEF DESCRIPTION OF THE DRAWINGS

By way of example only, embodiments of the present invention will now be described with reference to the accompanying figures in which.

It is noted that the figures show merely a preferred embodiment according to the invention. In the figures, the same reference numbers refer to equal or corresponding parts.

DETAILED DESCRIPTION OF THE INVENTION

Figure 1:
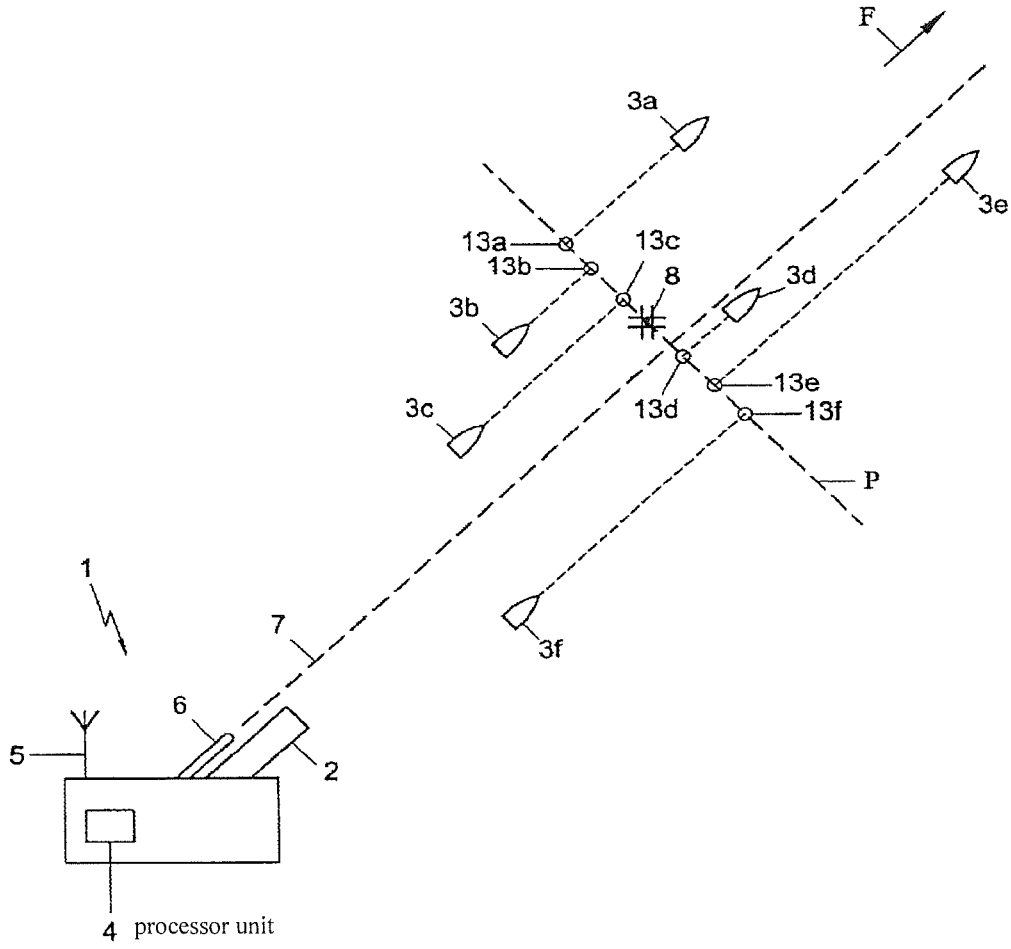
FIG. 1 shows a schematic view of a system according to the invention.

FIG. 1 shows a schematic view of a system 1 according to the invention. The system 1 includes a launch unit 2 for launching a salvo of projectiles 3*a-f*. Further, the system includes a processor unit 4 for performing a number of tasks. The system 1 also includes an antenna 5 for transmitting and receiving communication signals to and from the projectiles 3. In order to guide the projectiles 3, the system 1 includes a beam forming unit 6 for generating a beam 7 that serves to define a common coordinate system.

During operation of the system 1*a* multiple number of projectiles 3 are launched by the launch unit 2 in order to hit a predetermined target, e.g. a small aerial target using an artillery or mortar shell. The missiles 3*a-f* form a salvo. According to an aspect of the invention, dispersion parameters are associated to the salvo of guided projectiles and numerical values of the dispersion parameters are determined based on accuracy uncertainty. In this process, the projectiles 3 in the salvo are arranging themselves in a plane P, also called steering plane, normal to the firing direction F. By controlling the average distance between the projectiles 3, the chance that at least one projectile will hit the target is optimized. Similarly, when accuracy uncertainty is relatively small, the average distance between the projectiles can be reduced so that the hit chance increases.

The processor unit 4 is involved in the process of determining numerical values of the dispersion parameters. The accuracy uncertainty may include a target prediction position error, an aiming error and/or flight disturbance. Further, the step of determining numerical values of the dispersion parameters can also be based on target dimensions. As an example, if the target dimensions are relatively large or in case of a relatively large target prediction position error, the average distance between the projectiles 3 can be controlled to a relatively large value for optimizing a hit chance. Similarly, when accuracy uncertainty is relatively small, the average distance between the projectiles can be reduced so that the hit chance increases. The process of determining numerical values of the dispersion parameters is based on swarming techniques as explained below.

After launch of the projectiles 3, the beam forming unit 6 generates a beam 7, such as an RF beam or a laser beam, to define a common reference coordinate system. The reference system comprises a moving steering plane P that is normal to the beam 7 and therefore also normal to the general flight direction F of the projectiles. A centroid of the projectiles 3 is included in the steering plane P. By defining a geometric centre of the projectiles, the steering plane P can be defined as a coordinate system that moves with the projectiles 3 substantially along the generated beam 7.

Each of the projectiles 3 is provided with a sensor for determining the projectile position relative to the beam 7, that is, for determining the coordinates of the projection of the projectiles on the moving steering plane P. Thereto, the projectiles 3 transmit position data towards the antenna 5 of the system 1. Then, the centroid 8 of the missiles 3 is computed. Preferably, the computation of the centroid 8 is performed by the processor unit 4 based on the determined individual projectile positions. In principal, the centroid 8 can also be computed in another way, e.g. based on measurements performed by the system 1 itself, or by a processor unit on board of each or a selected number of missiles.

Then, based on the actual missile positions relative to the centroid 8 and on the numerical values of the dispersion parameters, the projected positions 13*a-f* of the missile positions on the steering plane P are controlled to an optimal dispersion by using a swarming technique.

According to a swarming technique, the members of the swarm attract each other if situated far away from each other, and repulse each other if situated close to each other.

According to a further aspect of the invention, the determined numerical values are converted to optimal position parameters of the launched individual guided projectiles in the common reference coordinate system. Preferably, the converting step is performed by a control unit on board of the individual projectiles. Thereto, the antenna 5 of the system 1 transmits centroid position data to the individual projectiles. As a next step, the individual projectiles move to the respective optimal position by controlling active steering mechanisms on board of the projectiles. Thus, flight paths of the individual guided projectiles are controlled in accordance with the determined respective dispersion parameter values. In this respect, it is noted that in another embodiment according to the invention, the processor unit 4 of the system 1 performs that computation of the optimal position parameters of the individual guided projectiles, and transmits control data to the projectiles.

The process of determining the positions of the projectiles in the steering plane P, determining the centroid 8 and determining a new set of optimal position parameters is executed iteratively, so that the dispersion of the salvo remains in concert with actual accuracy uncertainty, e.g. in view of an actual target error.

To summarize, according to a specific embodiment according to the invention, the system 1, also called launching platform, generates a beam 7 pointing in the direction of an (average) predicted intercept point (PIP). Each projectile 3 measures its position with respect to the center of the beam 7. The projectiles 3 sends its own position to the launching platform 1. The launching platform 1 receives the position information and computes the position of the centroid 8 of the projectiles. The launching platform 1 broadcasts the position of the centroid 8 to all the projectiles 3 to provide each projectile with position information of other projectiles, and each projectile 3 computes the required lateral acceleration based on its own position measurements and the information on the centroid position received from the launching platform 1, using a modified swarming law using its relative position to the centroid 8.

It is noted that instead of computing the position of the centroid 8, the position information of all the projectiles can be determined and provided to all projectiles, e.g. by broadcasting the projectile position information towards all projectiles via the launching platform 1.

Figure 2:
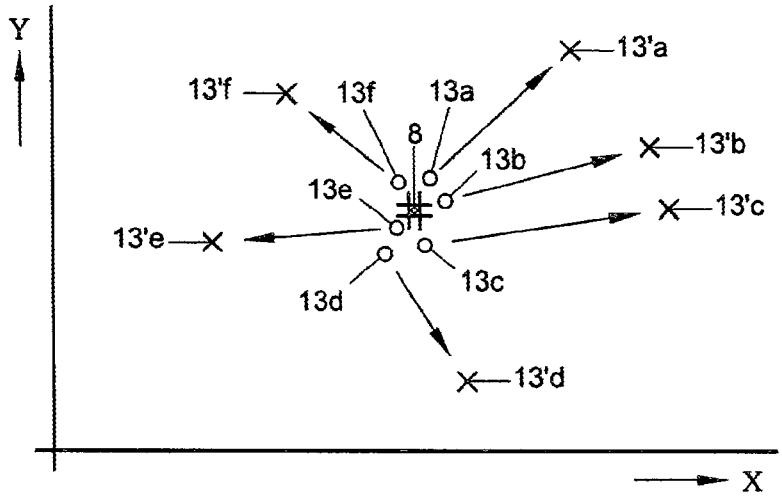
FIG. 2 shows projectile positions in a common reference coordinate system.

FIG. 2 shows projectile positions that are projected in a common reference coordinate system having, the steering plane P having an x-coordinate and an y-coordinate. In a first time instant, the projected positions 13*a-f* are close to the centroid 8. In a second time instant, after a number of control iterations, the projected projectile positions 13'*a-f* are more remote to the centroid 8. Then, a more dispersed configuration of missiles 13 has been obtained.

Figure 3:
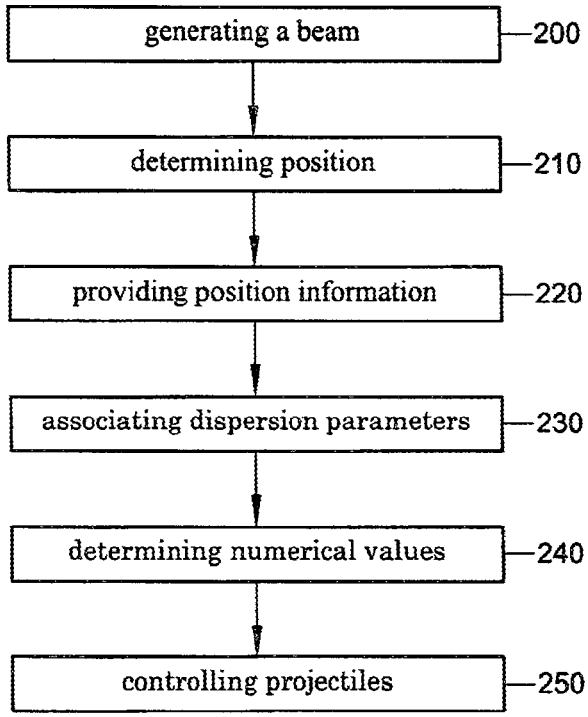
FIG. 3 shows a flow chart of an embodiment of a method according to the invention.

FIG. 3 shows a flow chart of an embodiment of the method according to the invention. A method is used for guiding a salvo of guided projectiles to a target. The method comprises the steps of generating (200) a beam defining a common reference coordinate system, determining (210) the position of each projectile relative to the beam, providing (220) to each projectile: position information of other projectiles, associating (230) dispersion parameters to the salvo of guided projectiles, determining (240) numerical values of the dispersion parameters based on accuracy uncertainty, and controlling (250) the projectiles to an optimal dispersion by using a swarming technique based on the position information of the projectiles and on the numerical values of the dispersion parameters.

The method of guiding a salvo of guided projectiles can be performed using dedicated hardware structures, such as FPGA and/or ASIC components. Otherwise, the method can also at least partially be performed using a computer program product comprising instructions for causing a processor of the computer system to perform the above described steps of the method according to the invention. All steps can in principle be performed on a single processor. However it is noted that at least one step can be performed on a separate processor, e.g. the step of determining numerical values of the dispersion parameters based on accuracy uncertainty.

It is noted that in a first embodiment according to the invention, a swarming technique is applied, based on the article "Stability analysis of swarms" in IEEE Transactions on Automatic Control by V. Gazi and K. Passino, 48(4):692-697, 2003. The main results of the cited reference refer to the stability of systems of the form $$x_i=\Sigma(x^j-x^i)g(\|x^j-x^i\|) \tag{1}$$

wherein $x^i$ represents the vector describing the position of member i of the swarm, and g is an attraction-repulsion function that ensures that the members of the swarm attract each other if situated far away from each other, and repulse each other if situated close to each other. In the cited reference, the function g is chosen as $$g(y)=a-be^{-y2/c} \tag{2}$$

where a, b, c are positive and b>a. However, in this approach it appears that a control of velocities is assumed while control of lateral acceleration is actually available. Further, vector relative measurements are needed, not just measurements on a relative distance. In addition, the stationarity of the centroid is not guaranteed. Also, the embodiment requires that all the projectiles in the salvo need information about the position of all the other projectiles in the salvo. This implies that each projectile has to send information about itself while receiving and processing information about all the other projectiles.

Figure 4:
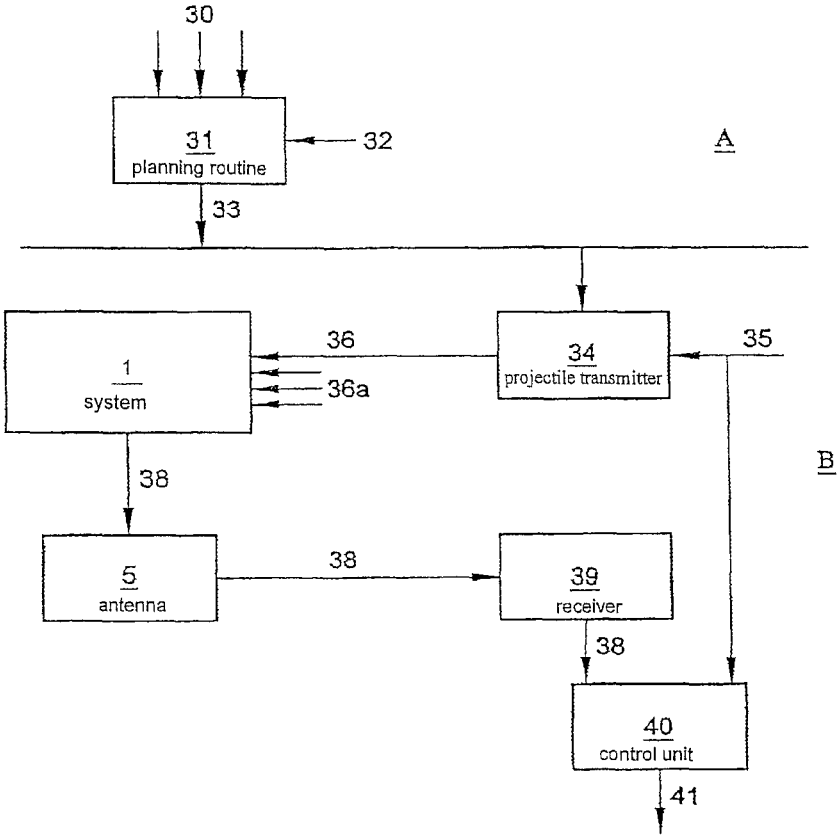
FIG. 4 shows a diagram illustrating the interaction of method steps according to an embodiment according to the invention.

In order to overcome at least one of the drawbacks of the embodiment described in the previous section, another approach can be adopted, as explained in more detail referring to FIG. 4. Here, each projectile sends information about its own position, the launching station receives this information and computes the position of the centroid of the projectiles, which is broadcasted to all the projectiles. Each projectile implements a modified swarming law using its relative position to the centroid. The modified swarming law is formulated as $$\dot{x}_i = v_i \tag{3}$$

$$\dot{v}_i = a_i$$

-continued $$\dot{a}_i = \frac{1}{\tau}[-a_i + k(-v_i + g(\|x_i - \hat{x}_c\|)(x_i - \hat{x}_c))]$$

$$\hat{x}_c = \frac{\sum_k x_k}{M}$$

wherein the latter expression defines the centroid and M denotes the number of projectiles in the salvo. Further, the function g is now chosen as $$g(x)\begin{cases} -1, & 0 < x < \delta - e, \\ 1, & x > \delta + e, \\ 0, & |x - \delta| \le e. \end{cases}$$

thus reducing computation time. Further, the function g merely depends on two parameters with a very clear significance, viz. δ representing the boundary between the attraction and the repulsion zones and ϵ is the length of a dead zone. The parameter ϵ should be chosen smaller than δ. It appears that the drift of the centroid is much smaller and the projectiles span themselves on a circle of radius close to the parameter δ.

FIG. 4 shows a diagram illustrating the interaction of method steps according to an embodiment according to the invention. The upper section A is dedicated to activities before launching a salvo. Similarly, the lower section B is dedicated to activities after launching the salvo. Further, the left hand side of FIG. 4 represents method steps that are performed at the processor unit 4 in the system 1, while the right hand side of FIG. 4 represents method steps that are performed in each projectile 3. Before launching a salvo, input data such as target track, target size and uncertainty data 30 are fed into a salvo planning routine 31. Also an intercept range 32 is fed into the routine 31. The routine 31 generates a salvo size as well as dispersion parameters 33 that are input to a transmitter 34 of a launched projectile 3. The projectile transmitter 34 transmits beam coordinates 36 based on beam sensor measurements 35 obtained at the transmitter 34. The beam coordinates 36, 36*a* are received at the system 1 for computing the centroid beam coordinates 38 that are sent to the antenna 5 of the system 1 for transmission to a receiver 39 of the individual projectiles 3. The centroid beam coordinates 38 are input to the control unit 40 of each projectile 3, together with the beam sensor measurements 35 of the projectile. Then, the control unit 40 generates swarming commands 41 for steering the projectile 3 according to the determined dispersion parameters.

Figure 5:
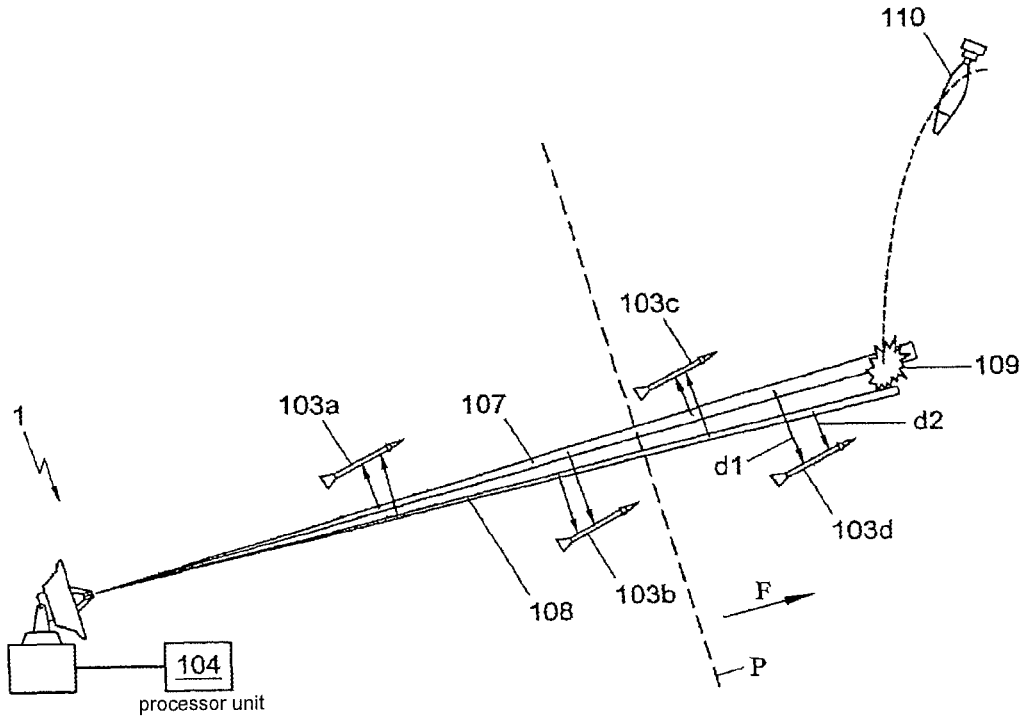
FIG. 5 shows a schematic view of another system according to the invention.

FIG. 5 shows a schematic view of another system 1 according to the invention. In this embodiment the step of providing position information to each projectile includes the steps of generating a centroid beam directed to the computed centroid of the projectiles, and determining the position of each projectile relative to the centroid beam, wherein the swarming technique is based on position information of the projectiles relative to the beam and to the centroid beam, and on the numerical values of the dispersion parameters. Similar to the first embodiment, shown in FIG. 1, the system 1 generates a beam 107 defining a common reference coordinate system including a steering plane P. The beam, also called PIP beam is directed towards a predicted intercept point 109 (PIP) being the expected point of intercepting an target 110, such as a hostile missile. Each projectile 103*a-d* measures its position relative to the beam 107 (i.e. including the distance d1 between the beam 108 and the projectile position).

In contrast to the first embodiment, the system 1 tracks the projectiles 103 and determines the angular position of the centroid with respect to the beam in the previous iteration, using the processor unit 104 of the system 1. The tracking process can be made easier by letting the projectiles transmit a specific beacon signal.

During operation, the system 1 generates a second beam 108, also called a centroid beam, directed to the computed centroid of the projectiles 103. Each projectile 103 now determines its position with respect to the centroid beam 108 (i.e. including the distance d2 between the centroid beam 108 and the projectile position), so that position information of the other projectiles is now provided to each projectile 103. Further, using swarming law based on position information of the projectiles 103 relative to the beam 107 and to the centroid beam 108, and on the numerical values of the dispersion parameters, the projectiles 103 can be controlled to an optimal dispersion, e.g. using formula (3).

Advantageously, there is no explicit data communication between the system 1 and the individual projectiles 103. In this way, the transmission link can be replaced on the launching site by a sensor, e.g. a RF sensor or an electro optical/infrared sensor, for tracking the salvo projectiles and determining its centroid with respect to the beam 107. On the projectile side, a transmitter/receiver module can be replaced by a sensor sensing the centroid beam 108 to measure the position of the projectile 103 with respect to the centroid beam. Optionally, a single beam sensor can be used on a time-sharing basis for determining the position with respect to both the beam 107 and the centroid beam 108.

The above-described dual beam approach avoids the use of dedicated communication tools that support a two-way communication between the system and the projectiles and meet short engagement time requirements and other design constraints.

It will be understood that the above described embodiments of the invention are exemplary only and that other embodiments are possible without departing from the scope of the present invention. It will be understood that many variants are possible.

The projectiles can be implemented as passive bullets or explosive elements, such as grenades forming a shell.

The launching station can be stationary as illustrated in FIG. 1, or may be mobile. The launching station can even be a dispenser of submunitions, in which case the projectiles in the salvo may be the submunitions.

Such variants will be apparent to the person skilled in the art and are considered to lie within the scope of the invention as defined in the following claims.

The invention claimed is:

1. A method of guiding a salvo of guided projectiles to a target, comprising the steps of:

generating a beam defining a common reference coordinate system;

determining the position of each projectile relative to the beam;

providing to each projectile: position information of other projectiles;

associating dispersion parameters to the salvo of guided projectiles;

determining numerical values of the dispersion parameters based on accuracy uncertainty; and controlling the projectiles to an optimal dispersion by using a swarming technique based on the position information of the projectiles and on the numerical values of the dispersion parameters.

2. A method according to claim 1, further comprising computing a centroid of the projectiles, wherein the position information provided to each projectile includes the coordinates of the centroid, and wherein the swarming technique is based on position information of the projectiles relative to the centroid and on the numerical values of the dispersion parameters.

3. A method according to claim 2, wherein the step of providing position information to each projectile includes the steps of:

generating a centroid beam directed to the computed centroid of the projectiles; and determining the position of each projectile relative to the centroid beam, wherein the swarming technique is based on position information of the projectiles relative to the beam and to the centroid beam, and on the numerical values of the dispersion parameters.

4. A method according to claim 1, wherein the step of providing position information to each projectile includes a step of broadcasting position information towards the projectiles.

5. A method according to claim 1, wherein the accuracy uncertainty includes a target prediction position error, an aiming error, a flight disturbance, and combinations thereof.

6. A method according to claim 1, wherein the step of determining numerical values of the dispersion parameters are also based on target dimensions.

7. A method according to claim 1, further comprising a step of converting the determined numerical values of the dispersion parameters to optimal position parameters of the launched individual guided projectiles in the common reference coordinate system.

8. A method according to claim 7, wherein the step of converting is performed by a control unit on board of the individual projectiles.

9. A method according to claim 1, wherein the step of computing a centroid is performed by a processor unit in a system for guiding a salvo of guided projectiles to a target.

10. A system for guiding a salvo of guided projectiles to a target, comprising a processor unit that is arranged for performing the steps of:

associating dispersion parameters to the salvo of guided projectiles; and determining numerical values of the dispersion parameters based on accuracy uncertainty; and controlling the projectiles to an optimal dispersion by using a swarming technique based on determined position information of the projectiles relative to a beam defining a common reference coordinate system, and on the numerical values of the dispersion parameters.

11. A system according to claim 10, further comprising an antenna for providing communication between launched individual guided projectiles and the processor unit.

12. A system according to claim 10, further comprising a beam forming unit for defining a common reference coordinate system for the individual projectiles.

13. A computer program product for guiding a salvo of guided projectiles to a target, the computer program product comprising a non-transitory computer readable medium having a computer program embodied thereon, the computer program including instructions for causing a processor to perform the steps of:

associating dispersion parameters to the salvo of guided projectiles; and determining numerical values of the dispersion parameters based on accuracy uncertainty; and controlling a transmitter that transmits control data for controlling the projectiles to an optimal dispersion by using a swarming technique based on determined position information of the projectiles relative to a beam defining a common reference coordinate system, and on the numerical values of the dispersion parameters.

* * * * *